US008218984B2

(12) United States Patent
Ota

(10) Patent No.: US 8,218,984 B2
(45) Date of Patent: Jul. 10, 2012

(54) TEMPERATURE CONTROLLING METHOD OF FIXING DEVICE

(75) Inventor: Hiroshi Ota, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 397 days.

(21) Appl. No.: 12/640,251

(22) Filed: Dec. 17, 2009

(65) Prior Publication Data

US 2010/0158555 A1 Jun. 24, 2010

Related U.S. Application Data

(60) Provisional application No. 61/140,018, filed on Dec. 22, 2008.

(51) Int. Cl.
*G03G 15/20* (2006.01)

(52) U.S. Cl. ..... 399/33; 399/69; 399/334

(58) Field of Classification Search ..... 399/33, 399/69, 328, 330, 334; 219/216
See application file for complete search history.

(56) References Cited

U.S. PATENT DOCUMENTS

| | | | | |
|---|---|---|---|---|
| 6,801,729 | B2 * | 10/2004 | Wada et al. | 399/68 |
| 6,965,741 | B2 * | 11/2005 | Senda | 399/33 |
| 7,519,306 | B2 * | 4/2009 | Inoue et al. | 399/69 |
| 7,664,416 | B2 * | 2/2010 | Watabe | 399/69 |

FOREIGN PATENT DOCUMENTS

| | | | |
|---|---|---|---|
| JP | 05289572 | A * | 11/1993 |
| JP | 11109781 | A * | 4/1999 |
| JP | 2001075418 | A * | 3/2001 |

* cited by examiner

*Primary Examiner* — Robert Beatty
(74) *Attorney, Agent, or Firm* — Turocy & Watson, LLP

(57) ABSTRACT

In a fixing device, when sheets of small width size are continuously passed and temperature rises in both side parts, a temperature control unit stops print control of an auxiliary lamp. When the temperature rise in both side parts continues after that, a drive control unit shifts the fixing device to a wait mode and pre-runs the fixing device. Moreover, in a low-temperature environment, when temperature rises in both side parts when sheets Ps of small width size are continuously passed, the temperature control unit switches temperature control of the fixing device to three-stage control.

20 Claims, 7 Drawing Sheets

| PRINT TIME (sec) | 0~60 (sec) | 61~120 (sec) | 121~ (sec) |
|---|---|---|---|
| CENTER THERMISTOR DETECTED TEMPERATURE (°C) | 190 (°C) | 185 (°C) | 180 (°C) |
| SIDE THERMISTOR DETECTION TEMPERATURE (°C) | 190 (°C) | 170 (°C) | 165 (°C) |

| PRINT TIME (sec) | 0~60 (sec) | 61~ (sec) |
|---|---|---|
| CENTER THERMISTOR DETECTED TEMPERATURE (°C) | 190 (°C) | 185 (°C) |
| SIDE THERMISTOR DETECTION TEMPERATURE (°C) | 190 (°C) | 170 (°C) |

TEMPERATURE CONTROLLING METHOD OF FIXING DEVICE

CROSS-REFERENCE TO RELATED APPLICATION

This application is based upon and claims the benefit of priority from Provisional U.S. Application 61/140,018 filed on Dec. 22, 2008, the entire contents of which are incorporated herein by reference.

TECHNICAL FIELD

The present invention relates to a controlling method for controlling the temperature of a fixing device used for an image forming apparatus such as a copier or MFP (multi-functional peripheral).

BACKGROUND

In an image forming apparatus, generally, the surface temperature of a heat roller is detected and the result of the detection is fed back to a heater, thus controlling the temperature of a fixing device. When the heat roller has a thin thickness and a small heat capacity, large temperature fluctuation occurs in the heat roller, depending on fixing conditions, and the temperature of the heat roller fluctuates instantaneously. Therefore, in the conventional technique, when the temperature of the heat roller becomes higher than a predetermined value, wait control of the image forming apparatus is immediately carried out to prevent adverse effects of the temperature rise of the heat roller.

However, when the surface temperature of the heat roller rises to a predetermined value and wait control of the image forming apparatus is suddenly started, there is a risk that the productivity of the image forming apparatus may be significantly lowered.

Thus, it is desired that a temperature controlling method of the fixing device that secures safety and prevents significant reduction in productivity of the image forming apparatus should be developed.

SUMMARY

According to an aspect of the invention, with finer feedback control of the fixing device, adverse effects of temperature rise of the heat roller are securely prevented without significantly lowering the productivity of the image forming apparatus.

According to an aspect of the invention, a temperature controlling method of a fixing device includes: carrying out temperature control of a fixing member which fixes a toner image to a recording medium by heating and pressurizing, divisionally in a first area and a second area in a direction of width; passing the recording medium to the fixing member; reducing power for heating the fixing member when a temperature difference between the first area and the second area reaches a first threshold value; and suspending the passing of the recording medium to the fixing member when the temperature difference still continues being equal to or higher than the first threshold value for a first predetermined time.

DETAILED DESCRIPTION

Figure 1:
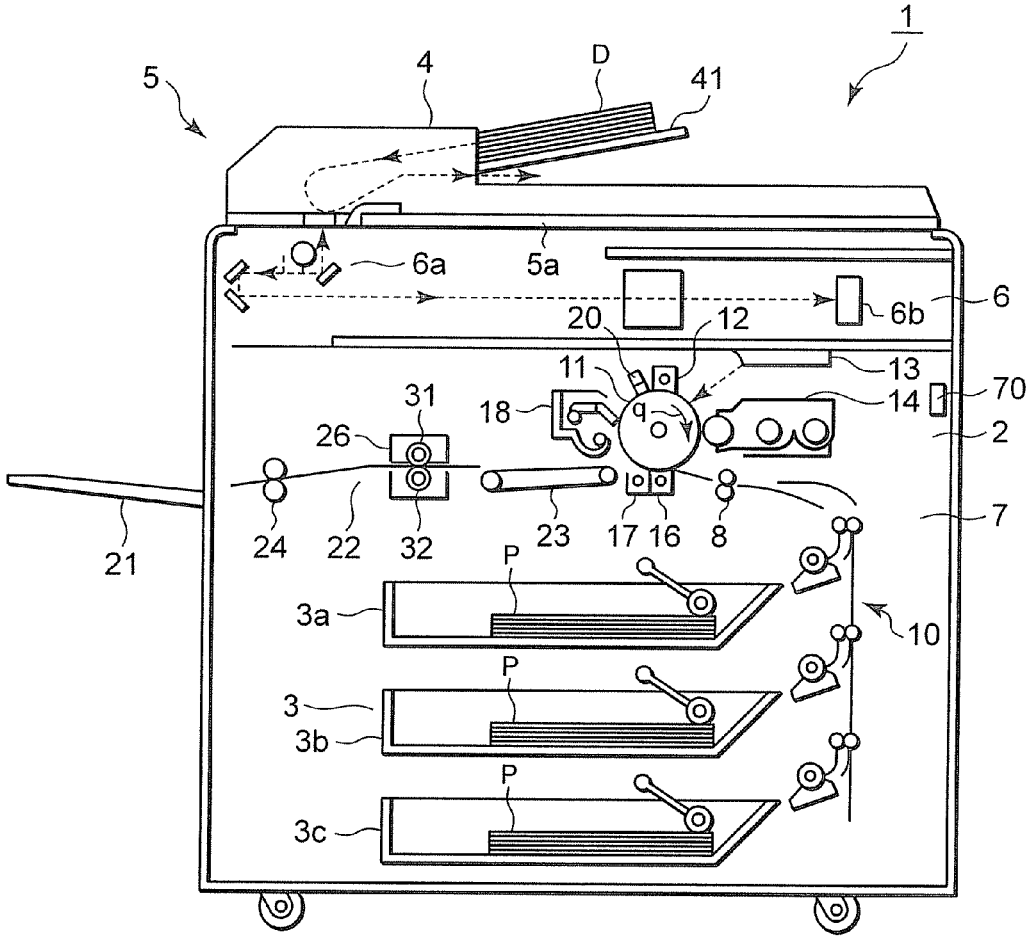
FIG. 1 is a schematic view of configuration showing a copier according to an embodiment.

Hereinafter, an embodiment will be described. FIG. 1 is a schematic view of configuration showing a copier 1 as an image forming apparatus equipped with a fixing device 26 according to the embodiment. The copier 1 has a printer unit 2, a scanner unit 5, and a paper supply unit 3.

The printer unit 2 has a charging device 12 which uniformly contacts and charges a photoconductive drum 11 as an image carrier member rotating in the direction of arrow q, and a laser exposure device 13 which casts a laser beam based on image data or the like from the scanner unit 5 to the charged photoconductive drum 11 and thus forms an electrostatic latent image on the photoconductive drum 11. The printer unit 2 also has a developing device 14 which supplies toner to the electrostatic latent image on the photoconductive drum 11, a transfer charger 16 as a transfer member which transfers the toner image formed on the photoconductive drum 11 to a sheet P as a recording medium, a separation charger 17 which separates the sheet P from the photoconductive drum 11, a cleaner 18, and a neutralizing device 20. The charging device 12, the laser exposure device 13 and the developing device 14 constitute an image forming member.

The scanner unit 5 is located above the printer unit 2. The scanner unit 5 has a scanner device 6 which scans an original placed on an original glass 5*a* or an original D carried by an automatic document feeder (ADF) 4. The scanner device 6 has an optical mechanism 6*a* which optically scans an original image, and a photoelectric conversion element (or CCD (charge coupled device)) 6*b* which converts optical signal from the optical mechanism 6*a* to an electric signal.

The paper supply unit 3 below the printer unit 2 has first to third paper supply cassettes 3*a*, 3*b* and 3*c*. Between the paper supply unit 3 and the photoconductive drum 11, there is a carrying mechanism 10 and a registration roller 8 which carries the sheet P to the space between the photoconductive drum 11 and the transfer charger 16 synchronously with the toner image on the photoconductive drum 11. Between the photoconductive drum 11 and a paper discharge unit 21, there is a carrying belt 23 which carries the sheet P having the toner image transferred thereto by the transfer charger 16, the fixing device 26 as a fixing member which nips and carries the sheet P and fixes the toner image to the sheet P by heating and pressurizing, and a paper discharge roller 24 which discharges the sheet P after the fixation to the paper discharge unit 21.

As printing is started, in the copier 1, after the charging device 12 charges the photoconductive drum 11, the laser exposure device 13 casts a laser beam onto the photoconductive drum 11 and forms an electrostatic latent image corresponding to the laser beam on the photoconductive drum 11. The developing device 14 provides toner for the electrostatic latent image on the photoconductive drum 11 and forms a toner image. The transfer charger 16 transfers the toner image on the photoconductive drum 11 to the sheet P passing between the photoconductive drum 11 and the transfer charger 16.

The fixing device 26 nips and carries the sheet P and fixes the toner image to the sheet P. After the toner image is fixed, the paper discharge roller 24 discharges the sheet P to the paper discharge unit 21.

Figure 2:
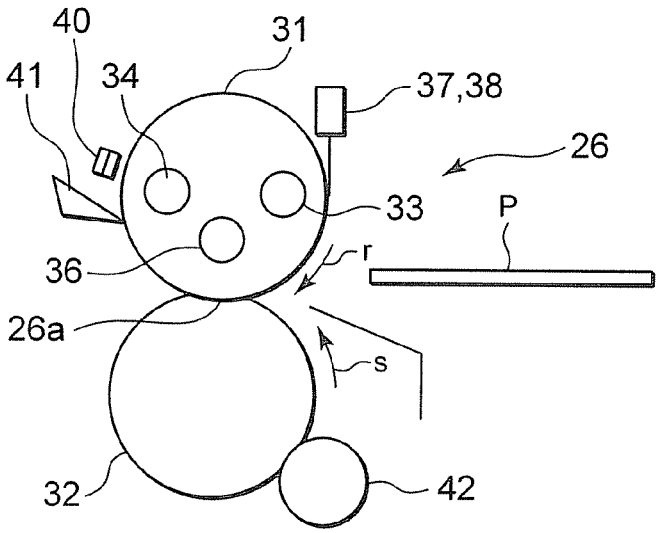
FIG. 2 is a schematic view of configuration showing a fixing device according to the embodiment.
Figure 3:
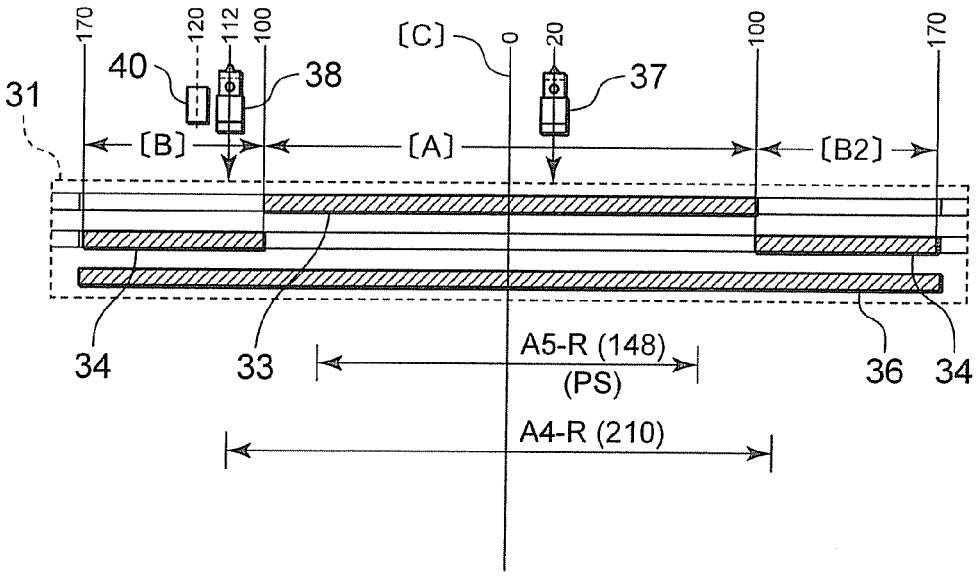
FIG. 3 is a schematic explanatory view showing a heat roller according to the embodiment.

The fixing device 26 has a heat roller 31 and a press roller 32 as fixing members, as shown in FIG. 2 and FIG. 3. The heat roller 31 has, for example, a surface layer made of a fluorine resin or the like around a 0.8 mm-thick aluminum roller. The press roller 32 has, for example, an elastic surface layer made of a silicone rubber on an iron roller.

The heat roller 31 and the press roller 32 are in pressure contact with each other and form a nip 26*a*. The fixing device 26 nips and carries the sheet P between the heat roller 31 and the press roller 32 and fixes the toner image by heating and pressurizing.

The heat roller 31 has, within a hollow part, a center lamp 33 with power consumption of 600 W as a first heat generating member, side lamps 34 with power consumption of 600 W on both sides of the center lamp 33, as second heat generating members, and an auxiliary lamp 36 with power consumption of 300 W as an auxiliary heat generating member. A main heat generating part of the center lamp 33 is, for example, 200 mm in length and is equivalent to a center area (A), which is a first area in the axial direction of the heat roller 31. Main heat generating parts of the side lamps 34 on both ends are, for example, 70 mm in length and are equivalent to side areas (B1) and (B2), which are second areas in the axial direction of the heat roller 31. The side areas (B1) and (B2) are located on both sides of the center area (A).

The length of the center lamp 33 is longer than the JIS standard A5-R size with a width of 148 mm and is shorter than the JIS standard A4-R size with a width of 210 mm. The side lamps 34 are in the areas on both sides of the center lamp 33. The center lamp 33 together with the side lamps 34 on both sides covers the JIS standard A3 size with a width of 297 mm. The auxiliary lamp 36 is, for example, 340 mm in length. The auxiliary lamp 36 as a single unit covers the center area (A) and the side areas (B1) and (B2) of the heat roller.

A center thermistor 37 as a first sensor of a detection member is situated at a distance of 20 mm from the center (C) in the longitudinal direction of the heat roller 31. Aside thermistor 38 as a second sensor of the detection member is situated at a distance of 112 mm from the center (C). The fixing device 26 also has a bimetal non-contact thermostat 40 at a distance of 120 mm from the center (C) of the heat roller 31. When the temperature of the bimetal exceeds, for example, 195° C. and anomaly is detected, the thermostat 40 forcedly disconnects lines that supply power to the center lamp 33, the side lamps 34 and the auxiliary lamp 36 and thus turns off power supply.

A separation pawl 41 separates the sheet P passed through the nip 26*a*, from the heat roller 31. A cleaning roller 42 cleans the surface of the press roller 32.

Figures 4, 5:
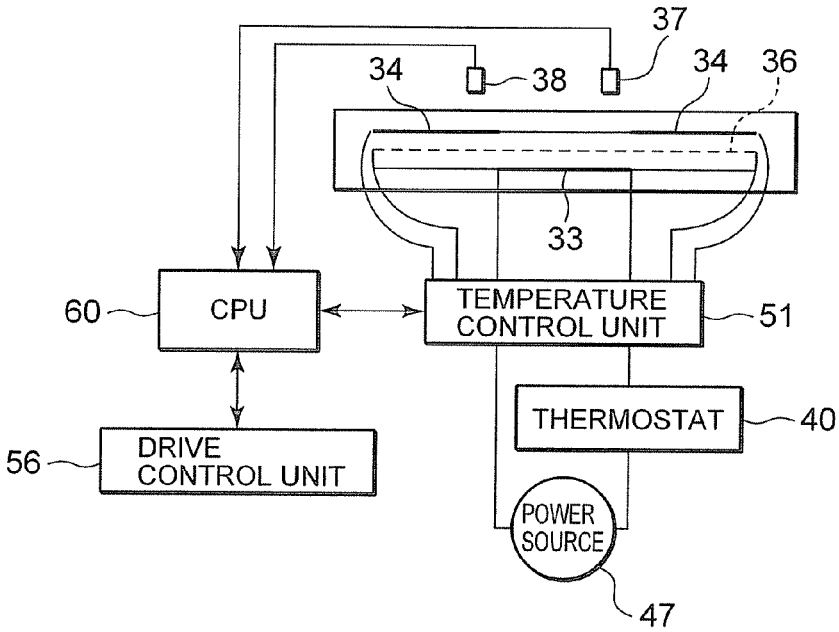
FIG. 4 is a schematic block diagram showing a control system of the heat roller according to the embodiment.
FIG. 5 is a table showing the set temperature of the heat roller when sheets are continuously passed in a normal-temperature environment according to the embodiment.

As shown in FIG. 4, a control system 50 as a control member which controls the temperature of the heat roller 31 and controls the passing of sheets to the fixing device 26 has a power source 47 which supplies power to the center lamp 33, the side lamps 34 and the auxiliary lamp 36. The power source 47 supplies power to the center lamp 33, the side lamps 34 and the auxiliary lamp 36 via the thermostat 40. A CPU 60 which controls the operation of the entire copier 1 controls a temperature control unit 51 which controls the temperature of the fixing device 26, and a drive control unit 56 which controls the operation of the copier 1. The CPU 60 controls the temperature control unit 51 and the drive control unit 56 in accordance with the results of temperature detection by the center thermistor 37 and the side thermistor 38.

The temperature control unit 51 controls power supply to the center lamp 33, the side lamps 34 and the auxiliary lamp 36 in accordance with an instruction from the CPU 60 based on the results of temperature detection by the center thermistor 37 and the side thermistor 38. The drive control unit 56 shifts the driving of the copier 1 from a print mode to a wait mode or from the wait mode to the print mode in accordance with an instruction from the CPU based on the results of temperature detection by the center thermistor 37 and the side thermistor 38. In the wait mode, the passing of sheets to the fixing device 26 is stopped and the heat roller 31 and the press roller 32 are rotated (pre-run).

The CPU 60 gives different instructions to the temperature control unit 51 in the case where sheets are continuously passed between when the copier 1 is in a normal-temperature environment and when the copier 1 is in a low-temperature environment. The normal-temperature environment refers to an environment with a temperature of 15 to 30° C. The low-temperature environment refers to an environment with a temperature lower than 15° C. The copier 1 has a temperature sensor 70 which detects the environmental temperature.

When the copier is in the normal-temperature environment and sheets are continuously passed, the temperature control unit 51 lowers the temperature in the center area (A) and the side areas (B1) and (B2) of the heat roller 31 in three stages in accordance with instructions from the CPU 60 and in accordance with the continuous passage time (first control), for example, as shown in FIG. 5.

When the copier is in the normal-temperature environment, and the continuous sheet passage time to the fixing device 26 is 0 to 60 seconds, the CPU 60 instructs the temperature control unit 51 to hold a detected temperature of 190° C. by the center thermistor 37 and a detected temperature of 190° C. by the side thermistor 38. When the continuous sheet passage time to the fixing device 26 is 61 to 120 seconds, the CPU 60 instructs the temperature control unit 51 to hold a detected temperature of 185° C. by the center thermistor 37 and a detected temperature of 170° C. by the side thermistor 38. When the continuous sheet passage time to the fixing device 26 is 121 seconds or longer, the CPU 60 instructs the temperature control unit 51 to hold a detected temperature of 180° C. by the center thermistor 37 and a detected temperature of 165° C. by the side thermistor 38.

Figures 6, 7:
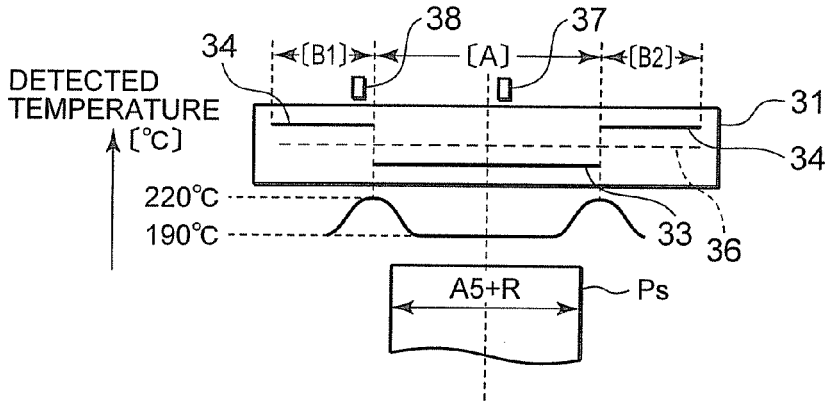
FIG. 6 is a table showing the set temperature of the heat roller when sheets are continuously passed in a low-temperature environment according to the embodiment.
FIG. 7 is an explanatory view showing temperature rise of a non-passage part when small-size sheets are continuously passed according to the embodiment.

When the copier is in the low-temperature environment and sheets are continuously passed, the temperature control unit 51 controls the temperature in the center area (A) and the side areas (B1) and (B2) of the heat roller 31 in two stages in accordance with instructions from the CPU 60 and in accordance with the continuous passage time (second control), for example, as shown in FIG. 6.

When the copier is in the low-temperature environment, and the continuous sheet passage time to the fixing device 26 is 0 to 60 seconds, the CPU 60 instructs the temperature control unit 51 to hold a detected temperature of 190° C. by the center thermistor 37 and a detected temperature of 190° C. by the side thermistor 38. When the continuous sheet passage time to the fixing device 26 is 61 seconds or longer, the CPU 60 instructs the temperature control unit 51 to hold a detected temperature of 180° C. by the center thermistor 37 and a detected temperature of 170° C. by the side thermistor 38.

When the copier is in the low-temperature environment, the fixing temperature of the fixing device 26 is controlled in two stages. As the temperature control of the fixing device is switched between the three-stage control for normal-temperature environment and the two-stage control for low-temperature environment, supplied power is saved in the normal-temperature environment and fixing failure due to insufficient temperatures is prevented in the low-temperature environment.

As the power source is turned on, the fixing device 26 starts warm-up. In the state where the driving of the heat roller 31 is stopped, the temperature control unit 51 carries out on- and off-control of the center lamp 33, the side lamps 34 and the auxiliary lamp 36 until the center thermistor 37 and the side thermistor 38 detects a ready temperature. After warm-up ends, the temperature control unit 51 carries out on- and off-control of the center lamp 33, the side lamps 34 and the auxiliary lamp 36 and holds the ready temperature.

As printing is started, the CPU 60 controls the temperature control unit 51 and the drive control unit 56 in the print mode. The drive control unit 56 rotates the heat roller 31 and the press roller 32 to nip and carry a sheet P having a toner image that is passed through the transfer charger 16. When the copier is in the normal-temperature environment, the temperature control unit 51 maintains the detected temperatures by the center thermistor 37 and the side thermistor 38 shown in FIG. 5. When the copier is in the low-temperature environment, the temperature control unit 51 maintains the detected temperatures by the center thermistor 37 and the side thermistor 38 shown in FIG. 6. The fixing device 26 fixes the toner image on the sheet P passing through the nip 26*a* by heating and pressurizing.

However, even though the temperature control unit 51 controls the temperature of the center lamp 33, the side lamps 34 and the auxiliary lamp 36, the temperature rises in non-passage parts (both side parts) of the center area (A) of the heat roller 31 when the sheet passing through the nip 26*a* has a smaller width size than the width of the center area (A). For example, when sheets of the JIS standard A5-R size are continuously passed as sheets Ps of small width size, the fixing temperature is maintained in the passage area of the center area (A) of the heat roller 31, but the temperature rises in the side areas (B1) and (B2) on both side parts, as shown in FIG. 7. If the passing of sheets is continued, the temperature becomes higher in both side parts and there is a risk that components of the fixing device 26 may be damaged.

When the sheets Ps of small width size are continuously passed and the temperature rises in both side parts, the CPU 60 instructs the temperature control unit 51 and the drive control unit 56 to perform control to secure safety of the fixing device 26.

Figure 8:
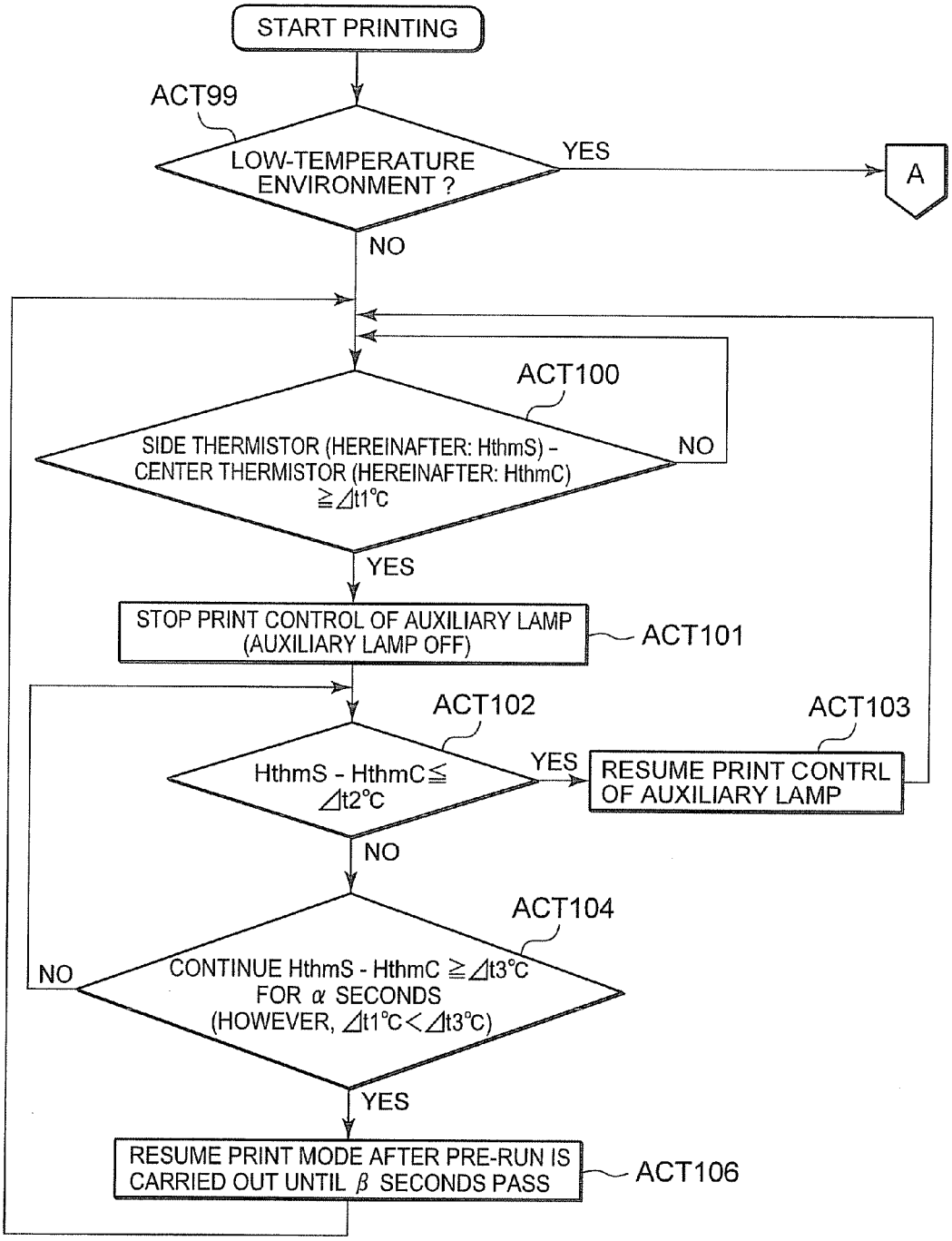
FIG. 8 is a flowchart showing control of the fixing device in the normal-temperature environment when small-size sheets are continuously passed according to the embodiment.
Figure 9:
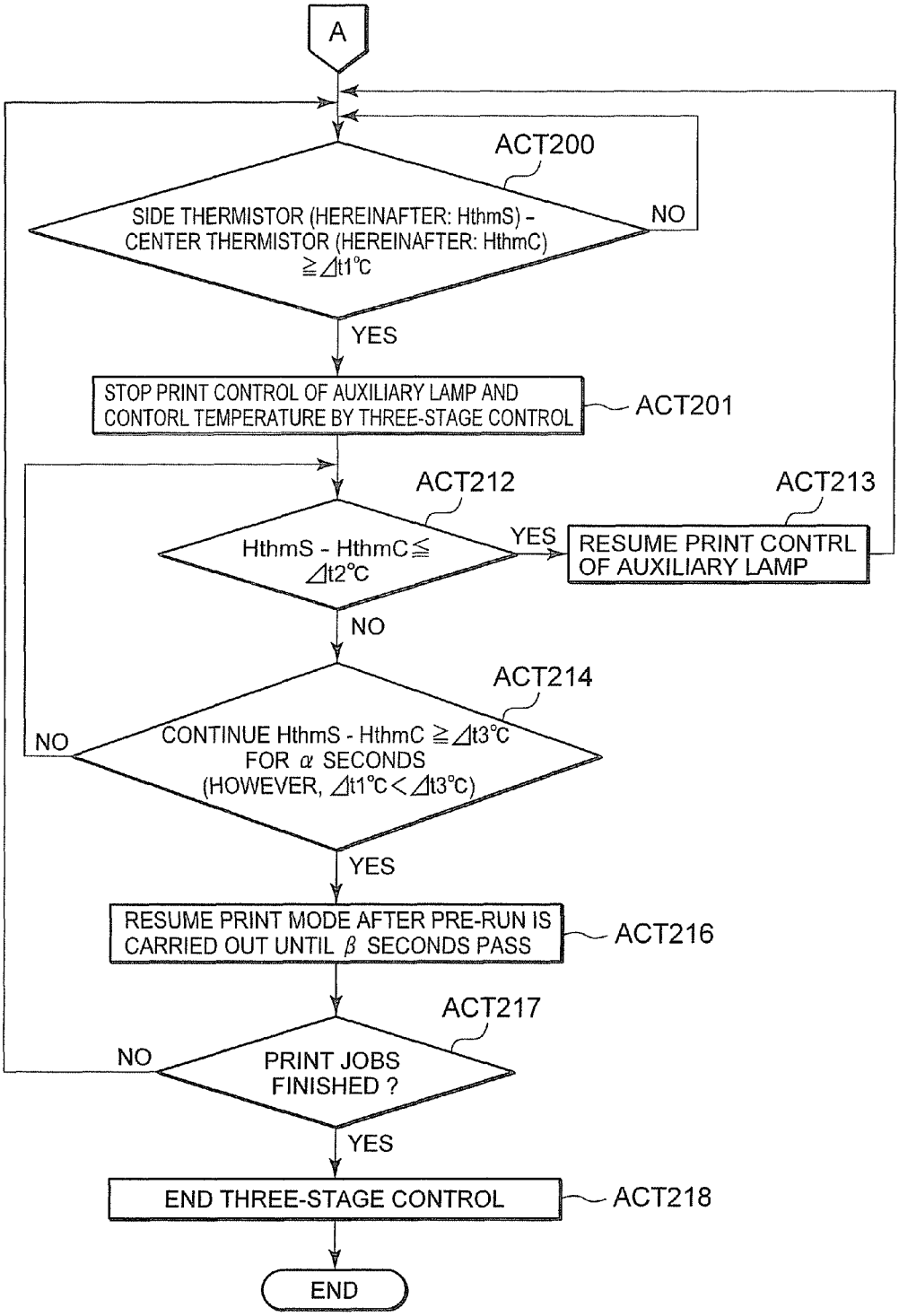
FIG. 9 is a flowchart showing control of the fixing device in the low-temperature environment when small-size sheets are continuously passed according to the embodiment.

FIG. 8 and FIG. 9 show the control of the fixing device 26 when the sheets Ps of small width size are continuously passed. As continuous printing on the sheets Ps of small width size is started, the CPU 60 determines whether the copier is in the normal-temperature environment or the low-temperature environment (ACT 99).

(1) In the normal-temperature environment (No in ACT 99), the CPU 60 proceeds to ACT 100 and calculates the temperature difference between the detected temperature (HthmC) by the center thermistor 37 and the detected temperature (HthmS) by the side thermistor 38. The CPU 60 determines whether or not the temperature difference is now equal to or greater than Δt1° C. (where Δt1° C. is a first threshold value).

For example, the temperature difference Δt1° C. is set to 25° C. When the temperature in both side parts, which are non-passage parts in the center area (A), rises and (HthmS)−(HthmC)≧Δt1° C. holds (Yes in ACT 100), the operation proceeds to ACT 101. In ACT 101, the temperature control unit 51 stops print control of the auxiliary lamp (the print control is on- and off-control of the auxiliary lamp 36 at the time of printing, according to needs). That is, the auxiliary lamp 36 is turned off.

Next, in ACT 102, the CPU 60 calculates the temperature difference between (HthmC) and (HthmS) and determines whether or not the temperature difference is now equal to or smaller than Δt2° C. (for example, 10° C.), which is a second threshold value. When the temperature falls in both side parts and (HthmS)−(HthmC)≦Δt2° C. holds (Yes in ACT 102), the operation proceeds to ACT 103. In ACT 103, the temperature control unit 51 resumes print control of the auxiliary lamp 36 and the CPU 60 returns to ACT 100.

When the temperature difference between (HthmS) and (HthmC) is not reduced to 10° C. or smaller in ACT 102 (No in ACT 102), the operation proceeds to ACT 104. In ACT 104, the CPU 60 calculates the temperature difference between (HthmC) and (HthmS) and determines whether or not a temperature difference of Δt3° C. (for example, 30° C.) or greater is continued for α seconds (for example, 60 seconds), which is a first predetermined time. In this case, Δt1° C.<Δt3° C. holds. If the temperature difference of 30° C. or greater between (HthmS) and (HthmC) is continued for α seconds (60 seconds) (Yes in ACT 104), the CPU 60 proceeds to ACT 106.

In ACT 106, since there is a risk of damage to the device, the drive control unit 56 shifts the driving of the copier 1 from the print mode to the wait mode, then continues the rotation of the heat roller 31 and the press roller 32, and stops supplying sheets to the fixing device 26. The fixing device 26 is pre-run and the temperature in both side parts is lowered. In ACT 106, after the shift to the wait mode, with the lapse of β seconds (for example, 30 seconds), which is a second predetermined time, the CPU instructs the drive control unit 56 to shift the operation of the copier 1 from the wait mode to the print mode. The drive control unit 56 resumes the passing of sheets to the fixing device 26. After ACT 106 ends, the operation returns to ACT 100. In ACT 106, when the temperature difference becomes (HthmS)−(HthmC)≦Δt4° C. (for example, 0° C.) after the shift to the wait mode, the drive control unit 56 may resume the passing of sheets to the fixing device 26.

In this manner, when temperature rises in both side parts when sheets Ps of small width size are continuously passed in the normal-temperature environment, the CPU 60 does not immediately give an instruction to shift the fixing device 26 from the print mode to the wait mode, and (a) the temperature control unit 51 first stops print control of the auxiliary lamp 36 in accordance with an instruction from the CPU 60. When the temperature rise continues in both side parts even after that, the CPU 60 gives an instruction to shift the fixing device 26 from the print mode to the wait mode, and (b) the drive control unit 56 pre-runs the fixing device 26 in the wait mode in accordance with an instruction from the CPU 60. That is, even if temperature rises in both side parts, the copier 1 continues printing unless this state of temperature rise continues. Thus, reduction in productivity of the copier 1 is restrained. However, when the temperature rise continues in both side parts, the fixing device 26 is pre-run and the temperature is lowered in both side parts, thus giving priority to safety of the fixing device 26. Therefore, in the copier 1, safety is not undermined and significant reduction in productivity can be restrained.

(2) In the low-temperature environment (Yes in ACT 99), the CPU 60 proceeds to ACT 200. The CPU 60 calculates the temperature difference between the detected temperature (HthmC) by the center thermistor 37 and the detected temperature (HthmS) by the side thermistor 38. The CPU 60 determines whether or not the temperature difference is now equal to or greater than Δt1° C.

For example, the temperature difference Δt1° C. is set to 25° C. When temperature rises in both side parts, which are non-passage parts in the center area (A), and (HthmS)−(HthmC)≧25° C. holds (Yes in ACT 200), the operation proceeds to ACT 201. In ACT 201, the temperature control unit 51 prohibits lighting of the auxiliary lamp 36. Moreover, the CPU 60 instructs the temperature control unit 51 to perform three-stage temperature control.

That is, in the low-temperature environment, the set time for which the heat roller 31 is maintained at 190° C. after the start of printing is longer than in the normal-temperature environment. In the low-temperature environment, if sheets Ps of small width size are continuously passed while the heat roller 31 is maintained at 190° C. until the set time passes, the temperature rise in both side parts becomes much greater than in the normal-temperature environment. Therefore, despite the low-temperature environment, temperature control is switched to three-stage control, giving priority to safety.

At the start of continuous passing of sheets Ps of small width size, the CPU 60 instructs the temperature control unit 51 to hold the detected temperature of 190° C. by the center thermistor 37 and the detected temperature of 190° C. by the side thermistor 38. When the temperature difference becomes (HthmS)−(HthmC)≧25° C., the CPU 60 instructs the temperature control unit 51 to hold the detected temperature of 180° C. by the center thermistor 37. After that, with the lapse of 121 seconds, the CPU 60 instructs the temperature control unit 51 to hold the detected temperature of 165° C. by the center thermistor 37.

Next, in ACT 212, the CPU 60 calculates the temperature difference between (HthmC) and (HthmS) and determines whether or not the temperature difference is not equal to or smaller than Δt2° C. (for example, 10° C.) When temperature falls in both side parts and the temperature difference becomes (HthmS)−(HthmC) Δt2° C. (Yes in ACT 212), the operation proceeds to ACT 213. In ACT 213, the temperature control unit 51 resumes print control of the auxiliary lamp 36 and the CPU 60 returns to ACT 200.

When the temperature difference between (HthmS) and (HthmC) is not reduced to 10° C. or smaller in ACT 212 (No in ACT 212), the operation proceeds to ACT 214. In ACT 214, the CPU 60 calculates the temperature difference between (HthmC) and (HthmS) and determines whether or not a temperature difference of Δt3° C. (for example, 30° C.) or greater is continued for α seconds (for example, 60 seconds). In this case, Δt1° C.<Δt3° C. holds. When the temperature difference of 30° C. or greater between (HthmS) and (HthmC) is continued for α seconds (60 seconds) (Yes in ACT 214), the CPU 60 proceeds to ACT 216.

In ACT 216, since there is a risk of damage to the device, the drive control unit 56 shifts the driving of the copier 1 from the print mode to the wait mode and pre-runs the fixing device 26. The drive control unit 56 pre-runs the fixing device 26 to lower the temperature in both side parts. After the shift to the wait mode, with the lapse of β seconds (for example, 30 seconds), the CPU instructs the drive control unit 56 to shift the operation of the copier 1 from the wait mode to the print mode. The drive control unit 56 resumes the passing of sheets to the fixing device 26.

In ACT 217, the CPU 60 determines whether a series of print jobs is finished or not. When all the print jobs are not finished (No in ACT 217), the operation returns to ACT 200. When all the print jobs are finished (Yes in ACT 217), the operation proceeds to ACT 218 and three-stage control ends.

In this manner, when sheets Ps of small width size are continuously passed in the low-temperature environment and temperature rises in both side parts, the CPU 60 does not immediately give an instruction to shift the fixing device 26 from the print mode to the wait mode. The temperature control unit 51 stops print control of the auxiliary lamp 36 in accordance with an instruction from the CPU 60. Along with this, the CPU 60 instructs the temperature control unit 51 to switch the temperature fall control of the fixing device 26 from two-stage control to three-stage control. If the temperature rise continues in both side parts even after that, the CPU 60 instructs the drive control unit 56 to shift the fixing device 26 from the print mode to the wait mode. The drive control unit 56 pre-runs the fixing device 26 in the wait mode.

Figure 10:
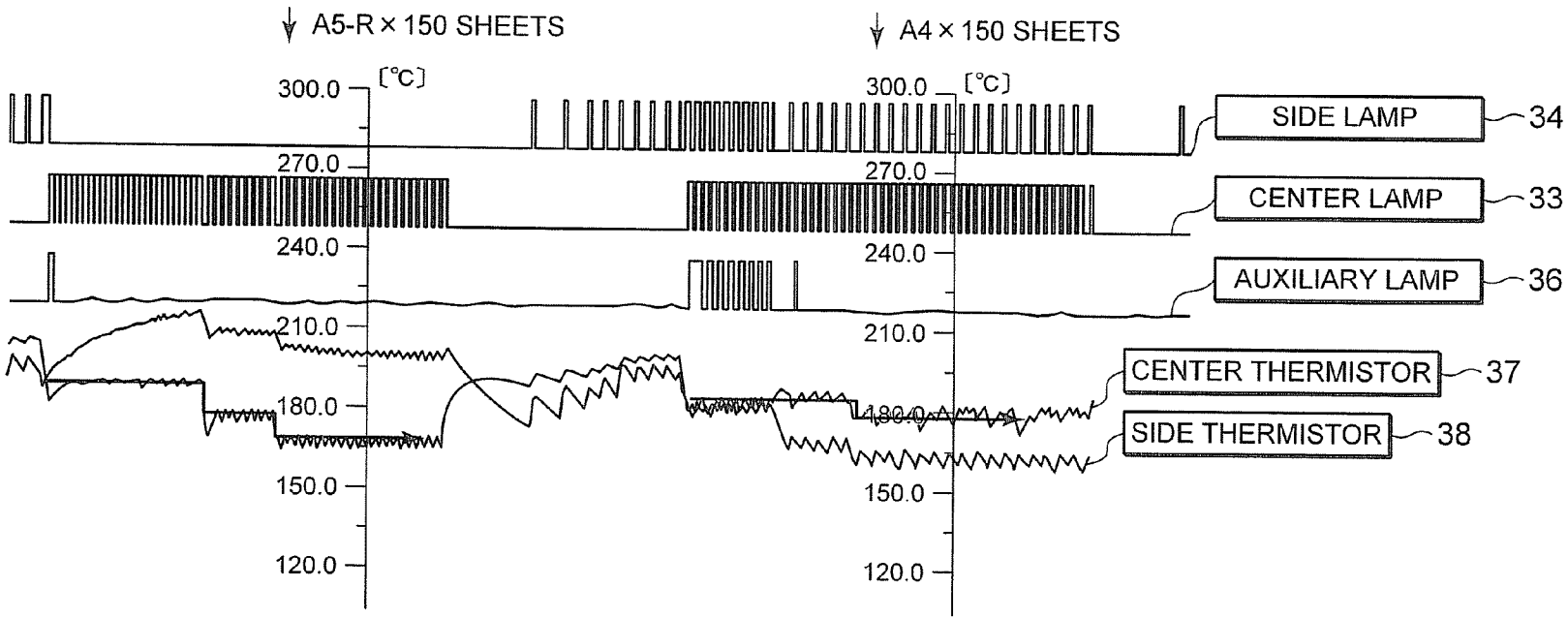
FIG. 10 is a graph showing an exemplary continuous sheet passage test in the low-temperature environment according to the embodiment.

FIG. 10 shows an exemplary continuous sheet passage test in the low-temperature environment. Sheets Ps of A5-R size, which is small width size, are continuously passed and the temperature of the side lamps is lowered in three stages using the set temperatures shown in FIG. 5. No fixing failure occurs then.

The invention is not limited to the above embodiment and various changes and modifications can be made without departing from the scope of the invention. For example, the fixing member is not limited to the structure for fixation to a recording medium where centering is done (with the center of the fixing member and the center of the recording medium are aligned with each other). The fixing member may carry out fixation with the recording medium aligned on one side (for example, the rear side of the fixing member and the rear side of the recording medium are aligned with each other). Also, the first threshold value, the second threshold value, the first predetermined time, the second predetermined time and so on are arbitrary in accordance with the characteristics of the fixing member. Moreover, the sensor which detects the surface temperature of the fixing member may be either a contact type sensor or a non-contact type sensor.

What is claimed is:

1. A temperature controlling method of a fixing device comprising:

carrying out temperature control of a fixing member which fixes a toner image to a recording medium by heating and pressurizing, divisionally in a first area and a second area in a direction of width;

passing the recording medium to the fixing member;

reducing power for heating the fixing member when a temperature difference between the first area and the second area reaches a first threshold value; and suspending the passing of the recording medium to the fixing member when the temperature difference continues being equal to or higher than the first threshold value for a first predetermined time.

2. The method according to claim 1, wherein the fixing member has a first heater and a second heater, the first area is a center area of the first heater, the second area is a side area next to the center area of the first heater, and when the temperature of the side area becomes higher than the temperature of the center area and the temperature difference between the side area and the center area reaches the first threshold value, electrification-of the second heater is turned off.

3. The method according to claim 2, wherein when the temperature of the side area is higher than the temperature of the center area and a state where the temperature difference between the side area and the center area is equal to or greater than the first threshold value continues for the first predetermined time, the passing of the recording medium to the fixing member is suspended.

4. The method according to claim 1, wherein the temperature control includes first control and second control to control electrification of the first heater, and wherein the temperature control is switched to control a set temperature of the first heater either by the first control or by the second control in accordance with environmental temperature and electrification state of the second heater, the lowest set temperature used in the first control being lower than the lowest set temperature used in the second control.

5. The method according to claim 4, wherein the second control is carried out in the environmental temperature is equal to or lower than a predetermined temperature and electrification of the second heater is on, and the first control is carried out in the environmental temperature is higher than the predetermined temperature or in the environmental temperature is equal to or lower than the predetermined temperature and electrification of the second heater is off.

6. A fixing device comprising:

a fixing member which is endless has a recording medium passed thereto and fixes a toner image to the recording medium by heating and pressurizing;

a first heat generating member which heats a first area in a direction of width of the fixing member;

a second heat generating member which is next to the first heat generating member and heats a second area next to the first area in the direction of width of the fixing member;

an auxiliary heat generating member which heats the fixing member, supplementing the first heat generating member and the second heat generating member;

a detection member which detects a temperature difference in the fixing member between the first area and the second area; and a control member which stops control of the auxiliary heat generating member when the temperature difference reaches a first threshold value, and which suspends the passing of the recording medium to the fixing member when a state where the temperature difference is equal to or greater than the first threshold value continues for a first predetermined time.

7. The device according to claim 6, wherein the fixing member has a first heater and a second heater, the first area is a center area of the first heater, the second area is a side area next to the center area of the first heater, and when the temperature of the side area becomes higher than the temperature of the center area and the temperature difference between the side area and the center area reaches the first threshold value, the control member turns off an electrification of the second heater.

8. The device according to claim 7, wherein when the temperature of the side area is higher than the temperature of the center area and a state where the temperature difference between the side area and the center area is equal to or greater than the first threshold value continues for the first predetermined time, the control member suspends the passing of the recording medium to the fixing member.

9. The device according to claim 6, wherein the temperature control includes first control and second control to control electrification of the first heater, and wherein the control member switches the temperature control to control a set temperature of the first heater either by the first control or by the second control in accordance with environmental temperature and electrification state of the second heater, the lowest set temperature used in the first control being lower than the lowest set temperature used in the second control.

10. The device according to claim 9, wherein the control member carries out the second control in the environmental temperature is equal to or lower than a predetermined temperature and electrification of the second heater is on, and the control member carries out the first control in the environmental temperature is higher than the predetermined temperature or in the environmental temperature is equal to or lower than the predetermined temperature and electrification of the second heater is off.

11. The device according to claim 6, wherein the detection member has a first sensor which detects a surface temperature of the fixing member in the first area, and a second sensor which detects a surface temperature of the fixing member in the second area.

12. The device according to claim 6, wherein the auxiliary heat generating member is a single auxiliary lamp covering the first area and the second area of the fixing member.

13. The device according to claim 6, wherein the control member resumes the stopped control of the auxiliary heat generating member when the temperature difference becomes equal to or smaller than a second threshold value.

14. The device according to claim 6, wherein the control member resumes the passing of the recording medium to the fixing member with the lapse of a second predetermined time after the passing of the recording medium to the fixing member is suspended.

15. An image forming apparatus comprising:

an image carrier member;

an image forming member which forms a toner image on the image carrier member;

a transfer member which transfers the toner image to a recording medium;

a fixing member which is endless has a recording medium passed thereto and fixes a toner image to the recording medium by heating and pressurizing;

a first heat generating member which heats a first area in a direction of width of the fixing member;

a second heat generating member which is next to the first heat generating member and heats a second area next to the first area in the direction of width of the fixing member;

an auxiliary heat generating member which heats the fixing member, supplementing the first heat generating member and the second heat generating member;

a detection member which detects a temperature difference in the fixing member between the first area and the second area; and a control member which stops control of the auxiliary heat generating member when the temperature difference reaches a first threshold value, and which suspends the passing of the recording medium to the fixing member when a state where the temperature difference is equal to or greater than the first threshold value continues for a first predetermined time.

16. The apparatus according to claim 15, wherein the fixing member has a first heater and a second heater, the first area is a center area of the first heater, the second area is a side area next to the center area of the first heater, and when the temperature of the side area becomes higher than the temperature of the center area and the temperature difference between the side area and the center area reaches the first threshold value, the control member turns off an electrification of the second heater.

17. The apparatus according to claim 15, wherein when the temperature of the side area is higher than the temperature of the center area and a state where the temperature difference between the side area and the center area is equal to or greater than the first threshold value continues for the first predetermined time, the control member suspends the passing of the recording medium to the fixing member.

18. The apparatus according to claim 15, wherein the temperature control includes first control and second control to control electrification of the first heater, and wherein the control member switches the temperature control to control a set temperature of the first heater either by the first control or by the second control in accordance with environmental temperature and an electrification state of the second heater, the lowest set temperature used in the first control being lower than the lowest set temperature used in the second control.

19. The apparatus according to claim 18, wherein the control member carries out the second control n the environmental temperature is equal to or lower than a predetermined temperature and electrification of the second heater is on, and the control member carries out the first control in the environmental temperature is higher than the predetermined temperature or in the environmental temperature is equal to or lower than the predetermined temperature and electrification of the second heater is off.

20. The apparatus according to claim 15, wherein the auxiliary heat generating member is a single auxiliary lamp covering the first area and the second area of the fixing member.

* * * * *